US011610711B2

(12) United States Patent
Yoshioka et al.

(10) Patent No.: US 11,610,711 B2
(45) Date of Patent: Mar. 21, 2023

(54) INDUCTOR COMPONENT

(71) Applicant: Murata Manufacturing Co., Ltd., Kyoto-fu (JP)

(72) Inventors: Yoshimasa Yoshioka, Nagaokakyo (JP); Kouji Yamauchi, Nagaokakyo (JP); Hironori Suzuki, Nagaokakyo (JP); Naoya Noo, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 421 days.

(21) Appl. No.: 16/843,563

(22) Filed: Apr. 8, 2020

(65) Prior Publication Data

US 2020/0381158 A1 Dec. 3, 2020

(30) Foreign Application Priority Data

May 27, 2019 (JP) ..... JP2019-098770

(51) Int. Cl.

| | |
|---|---|
| ***H01F 27/29*** | (2006.01) |
| ***H01F 17/00*** | (2006.01) |
| ***H01F 17/04*** | (2006.01) |
| ***H01F 27/28*** | (2006.01) |

(52) U.S. Cl.

CPC ..... *H01F 17/0013* (2013.01); *H01F 17/04* (2013.01); *H01F 27/2828* (2013.01); *H01F 27/292* (2013.01); *H01F 2017/0066* (2013.01); *H01F 2017/048* (2013.01)

(58) Field of Classification Search

CPC .. H01F 17/0013; H01F 17/04; H01F 27/2828; H01F 27/292; H01F 2017/0066; H01F 2017/048

See application file for complete search history.

(56) References Cited

U.S. PATENT DOCUMENTS

| | | | | |
|---|---|---|---|---|
| 10,395,827 | B2 * | 8/2019 | Ito | H01G 4/232 |
| 11,361,901 | B2 * | 6/2022 | Togawa | H01G 4/2325 |
| 2001/0017420 | A1 | 8/2001 | Iwao et al. | |
| 2001/0026017 | A1 | 10/2001 | Seto | |

(Continued)

FOREIGN PATENT DOCUMENTS

| | | |
|---|---|---|
| CN | 1172413 A | 2/1998 |
| CN | 1311513 A | 9/2001 |

(Continued)

OTHER PUBLICATIONS

An Office Action mailed by China National Intellectual Property Administration dated Nov. 24, 2021 which corresponds to Chinese Patent Application No. 202010304445.4 and is related to U.S. Appl. No. 16/843,563 with English language translation.

(Continued)

*Primary Examiner* — Hoa C Nguyen

(74) *Attorney, Agent, or Firm* — Studebaker & Brackett PC

(57) ABSTRACT

An inductor component comprising a laminated body having a magnetic layer containing a resin and a metal magnetic powder contained in the resin; an inductor wiring disposed in the laminated body; and an external terminal exposed from the laminated body. The external terminal includes a metal part and a resin part, and in a cross section of the external terminal, the resin part is enclosed in the metal part.

20 Claims, 4 Drawing Sheets

(56) References Cited

U.S. PATENT DOCUMENTS

| | | | | |
|---|---|---|---|---|
| 2016/0172108 | A1* | 6/2016 | Ikeda | H01G 4/2325 361/301.4 |
| 2018/0012697 | A1* | 1/2018 | Jung | H01F 27/292 |
| 2019/0115150 | A1 | 4/2019 | Yoshioka et al. | |
| 2019/0348212 | A1* | 11/2019 | Tozawa | H01F 41/042 |

FOREIGN PATENT DOCUMENTS

| | | | |
|---|---|---|---|
| JP | 2008-106290 | A | 5/2008 |
| JP | 2012-204441 | A | 10/2012 |
| JP | 2014013815 | A | 1/2014 |
| JP | 2015-023120 | A | 2/2015 |
| JP | 2017-195321 | A | 10/2017 |
| JP | 2018-170430 | A | 11/2018 |
| JP | 2019-075478 | A | 5/2019 |

OTHER PUBLICATIONS

An Office Action; "Notice of Reasons for Refusal," mailed by the Japanese Patent Office dated Jan. 5, 2022, which corresponds to Japanese Patent Application No. 2019-098770 and is related to U.S. Appl. No. 16/843,563 with English language translation.

* cited by examiner

INDUCTOR COMPONENT

CROSS REFERENCE TO RELATED APPLICATION

This application claims benefit of priority to Japanese Patent Application 2019-098770 filed May 27, 2019, the entire content of which is incorporated herein by reference.

BACKGROUND

Technical Field

The present disclosure relates to an inductor component.

Background Art

A conventional inductor component is described in Japanese Laid-Open Patent Publication No. 2014-13815. This inductor component includes a laminated body including a magnetic layer, an inductor wiring disposed in the laminated body, and an external terminal exposed from the laminated body.

SUMMARY

In the conventional inductor component, when a load such as heat is applied to the inductor component, stress is accumulated in the external terminal due to a difference in thermal expansion coefficient between the laminated body (magnetic layer) and the external terminal. Since the external terminal is exposed outside the inductor component, an external force is easily applied to the external terminal at the time of manufacturing, mounting, and usage of the inductor component. Such a stress or an external force may reduce the reliability of the external terminal.

Therefore, the present disclosure provides an inductor component capable of improving the reliability of the external terminal.

An aspect of the present disclosure provides an inductor component comprising a laminated body having a magnetic layer containing a resin and a metal magnetic powder contained in the resin; an inductor wiring disposed in the laminated body; and an external terminal exposed from the laminated body. The external terminal includes a metal part and a resin part, and in a cross section of the external terminal, the resin part is enclosed in the metal part.

The inductor wiring gives an inductance to the inductor component by generating a magnetic flux in a magnetic layer when a current is applied, and is not particularly limited in terms of structure, shape, material, etc.

According to the inductor component of the present disclosure, since the external terminal has the resin part enclosed in the metal part, the stress and the external force applied to the external terminal can be reduced by the resin part.

In an embodiment of the inductor component, preferably, the external terminal has a void part enclosed in the metal part.

According to the embodiment, the stress and the external force applied to the external terminal can further be reduced by the void part.

In an embodiment of the inductor component, preferably, the resin part is in contact with the void part.

According to the embodiment, the void part can absorb a change in volume of the resin part easily expanded and contracted due to a thermal load etc., so as to reduce a change in volume of the external terminal as a whole, thereby reducing the stress accumulated in the external terminal.

In an embodiment of the inductor component, preferably, the thickness of the inductor component is 0.3 mm or less.

According to the embodiment, the inductor component is formed as a thin type component in which the thickness of the external terminal tends to be relatively large, so that the reduction of the stress and the external force by the resin part becomes more effective.

In an embodiment of the inductor component, preferably, the thickness of the resin part is not less than 1/200 and not more than 1/5 (i.e., from 1/200 to 1/5) of the thickness of the external terminal.

According to the embodiment, since the thickness of the resin part is not more than 1/5 of the thickness of the external terminal, an increase in DC resistance and a decrease in terminal strength can be suppressed in the external terminal Since the thickness of the resin part is not less than 1/200 of the thickness of the external terminal, the effect of the resin part reducing the stress can reliably be produced.

In an embodiment of the inductor component, preferably, the thickness of the external terminal is not more than 1/20 of the thickness of the inductor component.

According to the embodiment, since the external terminal is formed thinly so that the reliability of the external terminal tends to be a problem, the reduction of the stress and the external force by the resin part becomes more effective. Additionally, an influence on the region of the inductor wiring can be reduced in the limited volume of the inductor component, so that the electrical characteristics of the inductor component can appropriately be ensured.

In an embodiment of the inductor component, preferably, the external terminal is made up of a plurality of conductor layers including at least one conductor layer formed by plating.

According to the embodiment, the conductor layers can have different multiple functions. For example, a first conductor layer can be made of Cu as a conductive layer and a planarization layer, a second conductor layer can be made of Ni as a solder-resistant layer, and a third conductor layer can be made of Au or Sn as a corrosion prevention layer and a solder-philic layer. Additionally, a conductor layer having a high purity of a metal element can be formed by plating.

In an embodiment of the inductor component, preferably, a thickness of each of the conductor layers of the external terminal is 10 μm or less.

According to the embodiment, each of the conductor layers of the external terminal is thin and has a structure in which reliability tends to be a problem, so that the reduction of the stress and the external force by the resin part becomes more effective. Additionally, an influence on the region of the inductor wiring can be reduced in the limited volume of the inductor component, so that the electrical characteristics of the inductor component can appropriately be ensured.

In an embodiment of the inductor component, preferably, the resin part contains at least one of epoxy, acrylic, phenol, and polyimide resins.

According to the embodiment, a commonly-used resin can be used for the resin part, so that the productivity is improved.

In an embodiment of the inductor component, preferably, the resin part contains silicon.

According to the embodiment, the diffusibility of the resin part is improved in the external terminal.

In an embodiment of the inductor component, preferably, based on a surface of the magnetic layer, the resin part is within a range of −5 μm to 5 μm in a direction perpendicular to the surface.

According to the embodiment, the resin part is located near the surface of the magnetic layer, so that when the magnetic layer is warped due to a thermal load, the stress of the external terminal can be reduced on the surface of the magnetic layer to which the largest stress is applied.

In an embodiment of the inductor component, preferably, the inductor wiring has a columnar wiring penetrating the magnetic layer, the external terminal is located on the columnar wiring, and the resin part is within a range of 5 μm from a circumferential edge of the columnar wiring toward the inside of the columnar wiring in planar view.

According to the embodiment, the resin part is located near the magnetic layer, so that when the magnetic layer is warped due to a thermal load, the stress of the external terminal can be reduced near the magnetic layer to which the largest stress is applied.

In an embodiment of the inductor component, preferably, the external electrode includes a crack.

According to the embodiment, the stress accumulated in the external electrode is released by the crack.

In an embodiment of the inductor component, preferably, the external terminal includes an overlapping portion on the inductor wiring and a non-overlapping portion on the magnetic layer, and the overlapping portion and the non-overlapping portion have different reflection spectra when light of a predetermined wavelength is applied from the outer surface side. In the embodiment, more preferably, a degree of unevenness on an outer surface of the non-overlapping portion is larger than a degree of unevenness on an outer surface of the overlapping portion.

The phrase "having different reflection spectra when light of a predetermined wavelength is applied" means that the reflection spectra of the light of a predetermined wavelength incident from the outer surface side of the external terminal have a difference identifiable visually or by a device in terms of at least one of brightness, saturation, and hue. Specifically, for example, when any light of a predetermined wavelength among infrared light, visible light, ultraviolet light, etc. is applied, and a difference can be identified as described above, the reflection spectra can be considered to be different.

According to the embodiment, the overlapping portion and the non-overlapping portion in the external terminal have different reflection spectra, so that the overlapping portion and the non-overlapping portion can be identified. As a result, even after the external terminal is formed, a connection position between the external terminal and the inductor wiring can be perceived. Specifically, the portions having the reflection spectra with lower brightness and higher brightness can be identified as the overlapping portion and the non-overlapping portion, respectively.

In an embodiment of the inductor component, preferably, the laminated body further includes an insulating coating film disposed on the surface of the magnetic layer, and the insulating coating film is disposed around the external terminal.

According to the embodiment, insulation can be enhanced between external terminals.

In an embodiment of the inductor component, preferably, a side surface of the external terminal is in contact only with the insulating coating film.

According to the embodiment, the external terminal is formed in an opening of the insulating coating film, and the connection area of the external terminal can be made larger, so that high connection reliability can be achieved.

In an embodiment of the inductor component, preferably, the inductor wiring is confirmable through the insulating coating film.

According to the embodiment, the connection position between the external terminal and the inductor wiring can more easily be perceived.

In an embodiment of the inductor component, preferably, the resin contains at least an epoxy resin between an epoxy resin and an acrylic resin.

According to the embodiment, the insulation among particles of the metal magnetic powder is ensured by the resin, so that an iron loss can be made smaller at high frequency.

In an embodiment of the inductor component, the magnetic layer further includes a ferrite powder.

According to the embodiment, containing the ferrite powder having a high relative magnetic permeability can improve an effective magnetic permeability, i.e., a magnetic permeability per volume of the magnetic layer.

According to the inductor component of an aspect of the present disclosure, the reliability of the external terminal can be improved.

DETAILED DESCRIPTION

An inductor component of an aspect of the present disclosure will now be described in detail with reference to shown embodiments. The drawings include schematics and may not reflect actual dimensions or ratios.

First Embodiment

Configuration

Figure 1A:
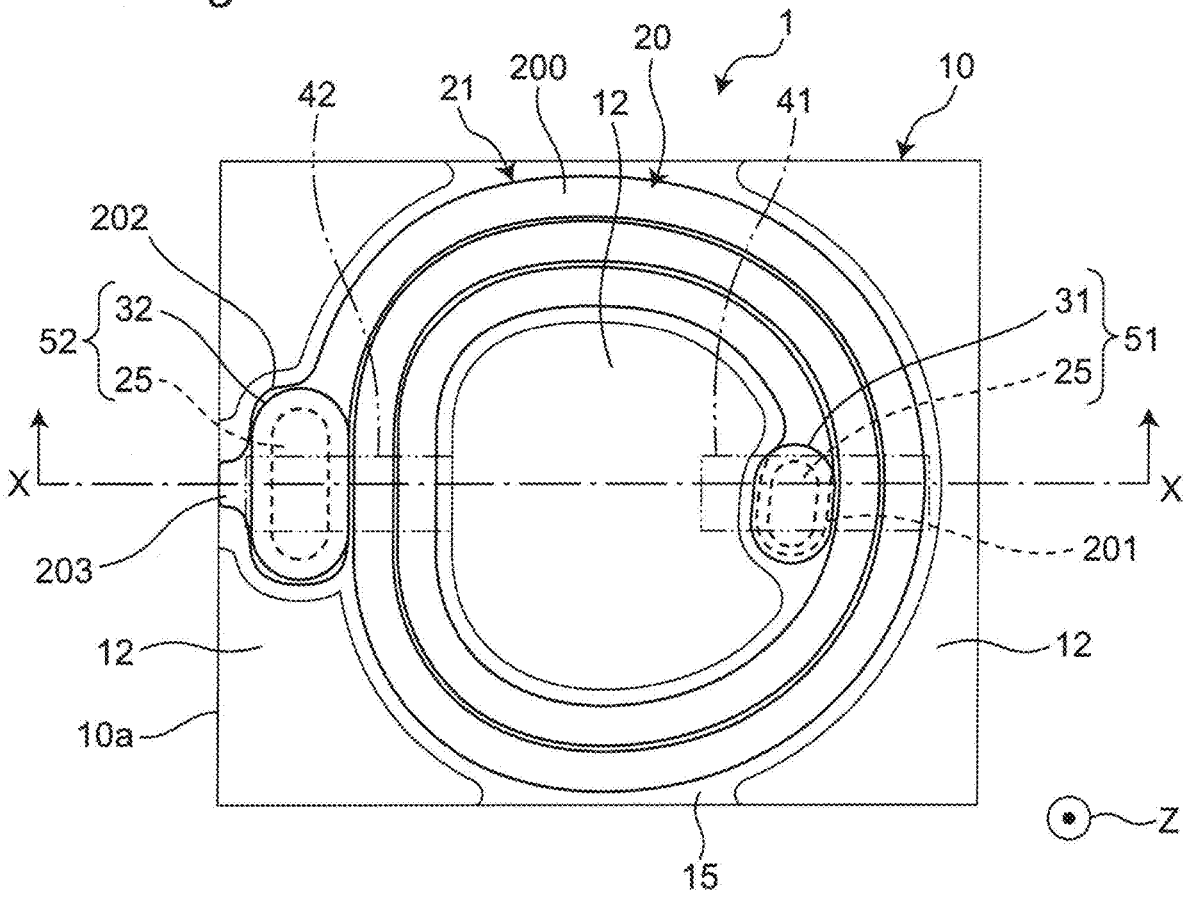
FIG. 1A is a transparent plan view showing an inductor component according to a first embodiment.
Figure 1B:
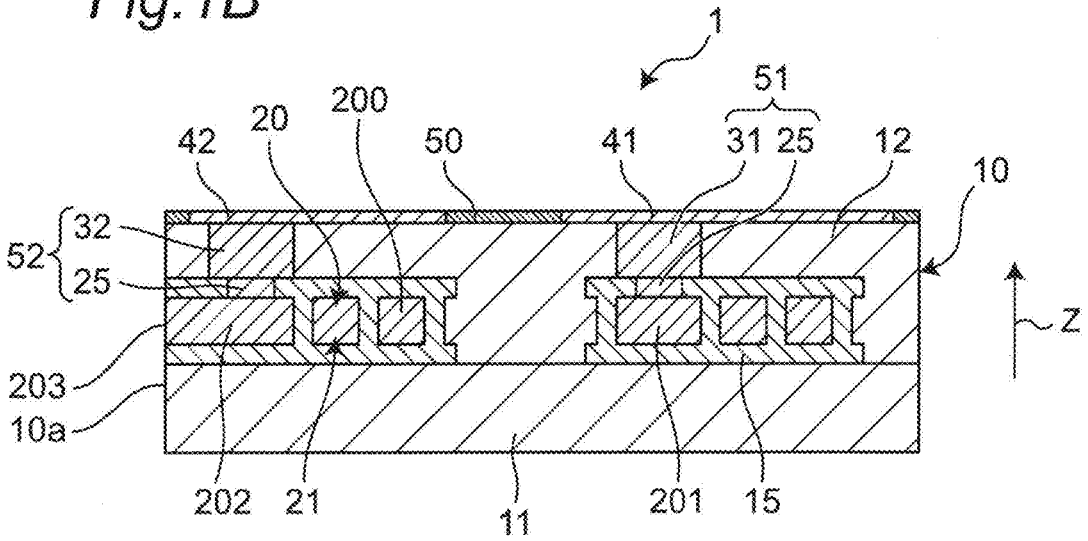
FIG. 1B is a cross-sectional view showing the inductor component according to the first embodiment.

FIG. 1A is a perspective plan view showing a first embodiment of an inductor component. FIG. 1B is a cross-sectional view taken along a line X-X of FIG. 1A.

An inductor component 1 is mounted on an electronic device such as a personal computer, a DVD player, a digital camera, a TV, a portable telephone, a smartphone, and automotive electronics, for example, and is a component generally having a rectangular parallelepiped shape, for example. However, the shape of the inductor component 1 is not particularly limited and may be a circular columnar shape, a polygonal columnar shape, a truncated cone shape, or a truncated polygonal pyramid shape.

As shown in FIGS. 1A and 1B, the inductor component 1 includes a laminated body 10, an inductor wiring 20, and external terminals 41, 42. The laminated body 10 includes a first magnetic layer 11, a second magnetic layer 12, an insulating layer 15, and an insulating coating film 50. The inductor wiring 20 is disposed in the laminated body 10 and includes a spiral wiring 21 and vertical wirings 51, 52 (an example of a lead-out wiring). The external terminals 41, 42 are exposed from the laminated body 10.

The first magnetic layer 11 and the second magnetic layer 12 are laminated in a first direction Z and have principal surfaces orthogonal to the first direction Z. The laminated body 10 may include not only the two layers, i.e., the first magnetic layer 11 and the second magnetic layer 12, but also three or more magnetic layers, or may include only one magnetic layer. In the figures, it is assumed that a forward direction and a reverse direction of the first direction Z face upward and downward, respectively.

The first magnetic layer 11 and the second magnetic layer 12 contain a resin and a metal magnetic powder contained in the resin. Therefore, high magnetic saturation characteristics can be obtained from the metal magnetic powder, and the resin insulates particles of the metal magnetic powder, so that an iron loss is reduced at high frequency.

The resin includes any of epoxy, polyimide, phenol, and vinyl ether resins, for example. This improves the insulation reliability. More specifically, the resin is epoxy, or a mixture of epoxy and acrylic, or a mixture of epoxy, acrylic, and another resin. As a result, the insulation among particles of the metal magnetic powder is ensured, so that the iron loss can be made smaller at high frequency.

The metal magnetic powder has an average particle diameter of 0.1 μm or more and 5 μm or less (i.e., from 0.1 μm to 5 μm), for example. In a manufacturing stage of the inductor component 1, the average particle diameter of the metal magnetic powder can be calculated as a particle diameter corresponding to 50% of an integrated value in particle size distribution obtained by a laser diffraction/scattering method. The metal magnetic powder is made of, for example, an FeSi alloy such as FeSiCr, an FeCo alloy, an Fe alloy such as NiFe, or an amorphous alloy thereof. The content percentage of the metal magnetic powder is, preferably, 20 vol % or more and 70 vol % or less (i.e., from 20 vol % to 70 vol %) relative to the whole magnetic layer. When the average particle diameter of the metal magnetic powder is 5 μm or less, higher magnetic saturation characteristics can be obtained, and the iron loss at high frequency can be reduced by fine powder. Instead of the metal magnetic powder, magnetic powder of NiZn- or MnZn-based ferrite may be used. Containing the ferrite powder having a high relative magnetic permeability as described above can improve an effective magnetic permeability, i.e., a magnetic permeability per volume of the first and second magnetic layers 11, 12.

The spiral wiring 21 is formed only on the upper side of the first magnetic layer 11, or specifically, on the insulating layer 15 on an upper surface of the first magnetic layer 11 and is a wiring having a shape extending in a direction parallel to the principal surface of the first magnetic layer 11. In this embodiment, the number of turns of the spiral wiring 21 exceeds one and is about 2.5. The spiral wiring 21 is spirally wound in a clockwise direction from an outer circumferential end toward an inner circumferential end when viewed from the upper side, for example.

In the above description, the spiral shape means a curve (two-dimensional curve) extending on a plane, and the number of turns drawn by the curve may be more than one or less than one. The spiral shape may have a curve wound in a different direction or may have a portion that is a straight line.

The thickness of the spiral wiring 21 is preferably 40 μm or more and 120 μm or less (i.e., from 40 μm to 120 μm), for example. An example of the spiral wiring 21 has a thickness of 45 μm, a wiring width of 50 μm, and an inter-wiring space of 10 μm. The inter-wiring space is preferably 3 μm or more and 20 μm or less (i.e., from 3 μm to 20 μm). The thickness of the spiral wiring 21 refers to a maximum dimension along the first direction Z in a cross section orthogonal to the extending direction of the spiral wiring 21.

The spiral wiring 21 is made of a conductive material and is made of a metal material having a low electric resistance such as Cu, Ag, Au, Fe, or a compound thereof, for example. As a result, the electric conductivity can be reduced, and the DC resistance can be reduced. In this embodiment, the inductor component 1 includes only one layer of the spiral wiring 21, so that the inductor component 1 can be reduced in height. Multiple layers of the spiral wiring 21 may be included, and the multiple layers of the spiral wiring 21 may electrically be connected in series by via wirings. Therefore, a winding shape (helical shape) may be formed by the multiple layers of the spiral wiring 21 and the via wirings. The winding shape may be a helical shape advancing parallel to the first direction Z or may be a helical shape advancing in a direction perpendicular to the first direction Z.

The spiral wiring 21 includes a spiral part 200, pad parts 201, 202, and a lead-out part 203 arranged on a plane orthogonal to the first direction Z (in a direction parallel to the principal surface of the first magnetic layer 11) and connected to each other. The first pad part 201 is disposed at an inner circumferential end of the spiral part 200, and the second pad part 202 is disposed at an outer circumferential end of the spiral part 200. The spiral part 200 is spirally wound between the first pad part 201 and the second pad part 202. The first pad part 201 is connected to the first vertical wiring 51, and the second pad part 202 is connected to the second vertical wiring 52. The lead-out part 203 is led out from the second pad part 202 to a first side surface **10*a* of the laminated body 10 parallel to the first direction Z and is exposed to the outside from the first side surface 10*a* of the laminated body 10**.

The insulating layer 15 is a film-shaped layer formed on the upper surface of the first magnetic layer 11 and covers the spiral wiring 21. Since the spiral wiring 21 is covered with the insulating layer 15, insulation reliability can be improved. Specifically, the insulating layer 15 entirely covers the bottom and side surfaces of the spiral wiring 21 and covers a portion of the upper surface of the spiral wiring 21 except connection portions of the pad parts 201, 202 for via wirings 25. The insulating layer 15 has holes at positions corresponding to the pad parts 201, 202 of the spiral wiring 21. The holes can be formed by photolithography or laser opening, for example. The thickness of the insulating layer 15 between the first magnetic layer 11 and the bottom surface of the spiral wiring 21 is 10 μm or less, for example.

The insulating layer 15 is made of a nonmagnetic insulating material containing no magnetic substance and is made of, for example, a resin material such as an epoxy resin, a phenol resin, a polyimide resin. The insulating layer 15 may contain a filler of a nonmagnetic substance such as silica and, in this case, the insulating layer 15 can be improved in the strength, workability, and electrical characteristics. The insulating layer 15 is not an essential constituent element, and the spiral wiring 21 may be in direct contact with the first magnetic layer 11 and the second magnetic layer 12. The insulating layer 15 may only partially cover the bottom surface, the side surfaces, the upper surface, etc. of the spiral wiring 21.

The vertical wirings 51, 52 are made of a conductive material, extend in the first direction Z from the pad parts 201, 202 of the spiral wiring 21, and are connected to the spiral wiring 21 and the external terminals 41, 42. Since the vertical wirings 51, 52 penetrate the second magnetic layer 12, unnecessary routing can be avoided for connecting the external terminals 41, 42 to the spiral wiring 21. The vertical wirings 51, 52 include the via conductors 25 extending from the pad parts 201, 202 of the spiral wiring 21 in the first direction Z and penetrating the inside of the insulating layer 15 and columnar wirings 31, 32 extending from the via conductors 25 in the first direction Z and penetrating the inside of the second magnetic layer 12. The columnar wirings 31, 32 are exposed from an upper surface of the second magnetic layer 12.

The first vertical wiring 51 includes the via conductor 25 extending upward from the upper surface of the first pad part 201 of the spiral wiring 21 and the first columnar wiring 31 extending upward from the via conductor 25 and penetrating the inside of the first magnetic layer 11. The second vertical wiring 52 includes the via conductor 25 extending upward from the upper surface of the second pad part 202 of the spiral wiring 21 and the second columnar wiring 31 extending upward from the via conductor 25 and penetrating the inside of the first magnetic layer 11. The vertical wirings 51, 52 are made of the same material as the spiral wiring 21.

The external terminals 41, 42 are made of a conductive material. The first external terminal 41 is disposed from on the first columnar wiring 31 onto the second magnetic layer 12 and is exposed from the upper surface of the laminated body 10. As a result, the first external terminal 41 is electrically connected to the first pad part 201 of the spiral wiring 21. The second external terminal 42 is disposed from on the second columnar wiring 32 onto the second magnetic layer 12 and is exposed from the upper surface of the laminated body 10. As a result, the second external terminal 42 is electrically connected to the second pad part 202 of the spiral wiring 21.

Preferably, the external terminals 41, 42 are made up of multiple conductor layers. As a result, the conductor layers can have different multiple functions. For example, a first conductor layer can be made of Cu as a conductive layer and a planarization layer, a second conductor layer can be made of Ni as a solder-resistant layer, and a third conductor layer can be made of Au or Sn as a corrosion prevention layer and a solder-philic layer. At least one conductor layer is preferably formed by plating, and a conductor layer having a high purity of a metal element can be formed by plating.

Preferably, the conductor layers constituting outer surfaces of the external terminals 41, 42 are made of Au or Sn or an alloy containing Au or Sn. As a result, a corrosion prevention treatment or favorable solder wettability of the external terminals 41, 42 can be ensured, which enables stable mounting.

Preferably, first conductor layers defined as first layers of the external terminals 41, 42 directly connected to the inductor wiring 20 is made of Cu or an alloy mainly composed of Cu. As a result, by using a material with low electric conductivity for the first conductor layers, DC resistance can be reduced in the external terminals 41, 42.

Preferably, the first conductor layers contain 95 wt % or more Cu and 1 wt % or more and 5 wt % or less (i.e., from 1 wt % to 5 wt %) Ni. As a result, since the stress of the first conductor layers is released by containing Ni, and a shift toward a non-stress side is achieved, the stress on the inductor wiring 20 can be reduced, and the connectivity is improved between the external terminals 41, 42 and the inductor wiring 20. Since an amount of Ni is small, an increase in DC resistance in the first conductor layer can be suppressed.

Preferably, the first conductor layers of the external terminals 41, 42 are made of Ni or an alloy containing Ni as a main component. As a result, Ni formed on the vertical wirings 51, 52 can serve as a barrier to suppress erosion of the vertical wirings 51, 52 by solder. Specifically, an alloy layer of Ni is made of an NiP alloy containing 2 wt % to 10 wt % P, for example. In this case, a catalyst layer of Pd etc. exists between an underlayer (the magnetic layer and the columnar wiring) and the Ni layer. The catalyst layer is not a layer constituting the external terminals 41, 42. The catalyst layer may be a portion of the configuration of the external terminals 41, 42.

The insulating coating film 50 is made of a nonmagnetic insulating material and is disposed on the upper surface of the second magnetic layer 12 serving as an outer surface, exposing a portion of the second magnetic layer 12, the columnar wirings 31, 32, and end surfaces of the external terminals 41, 42. The insulation of the surface of the inductor component 1 can be ensured by the insulating coating film 50. By disposing the insulating coating film 50 around the first external terminal 41 and the second external terminal 42, the insulation can be enhanced between the first external terminal 41 and the second external terminal 42 to improve the reliability. The insulating coating film 50 may be formed on the lower surface side of the first magnetic layer 11.

The side surfaces of the first external terminal 41 and the second external terminal 42 are in contact with only the insulating coating film 50, which means that the first external terminal 41 and the second external terminal 42 are formed in openings of the insulating coating film 50. Therefore, the connection areas of the first external terminal 41 and the second external terminal 42 can be made larger, and high connection reliability can be achieved. For example, assuming that the external terminals 41, 42 are made up of first Cu layers, second Ni layers and third Au layers, when the Cu, Ni, and Au layers are 5 μm, 5 μm, and 0.08 μm, respectively, and the insulating coating film 50 is 5 μm, the insulating coating film 50 is present on the side surface of the Cu layer, while the insulating coating film 50 is not present on the side surface of the Ni layer, and a portion of the Ni layer is formed on the insulating coating film 50.

Figure 2:
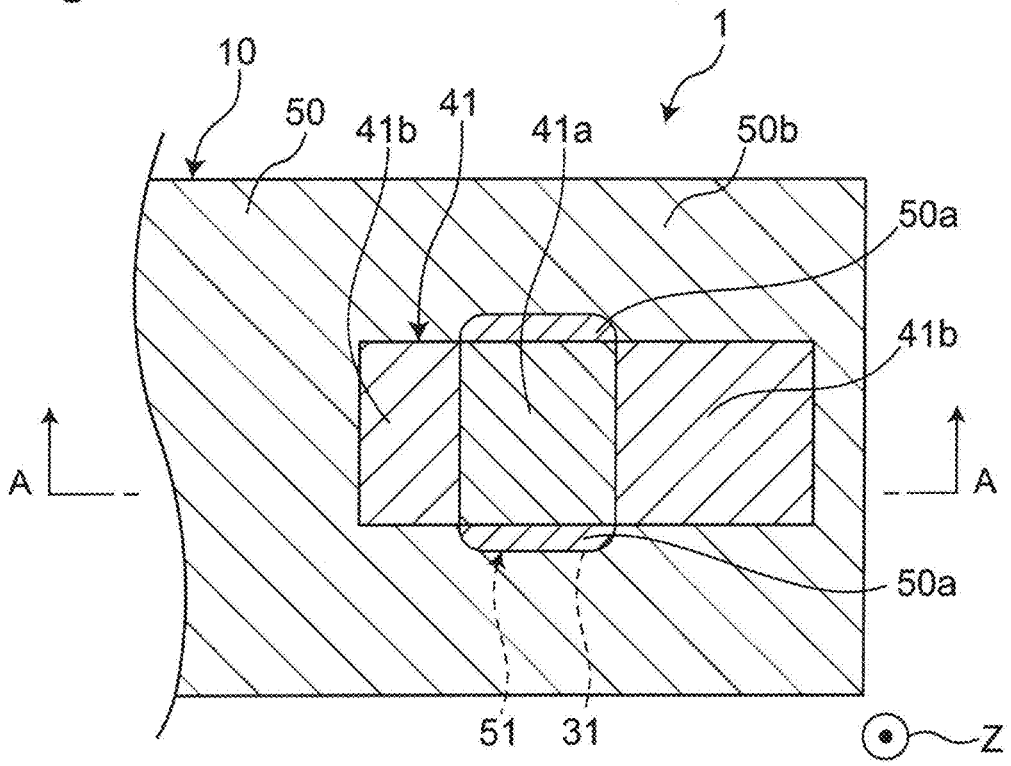
FIG. 2 is a simplified plan view showing a positional relationship between a first external terminal and a first vertical wiring.

FIG. 2 is a simplified plan view showing a positional relationship between the first external terminal 41 and the first vertical wiring 51 as viewed in the first direction Z. As shown in FIG. 2, when viewed in the first direction Z, a portion of the first external terminal 41 overlaps with a portion of the first vertical wiring 51 (the first columnar wiring 31).

The first external terminal 41 has an overlapping region on the first vertical wiring 51 (the inductor wiring 20) and a non-overlapping region not in contact with the first vertical wiring 51 (the inductor wiring 20), and the overlapping region and the non-overlapping region have different reflection spectra when light of a predetermined wavelength is applied from the outer surface side.

Specifically, the first external terminal 41 has an overlapping portion 41*a* in contact with the first vertical wiring 51 (the first columnar wiring 31) and a non-overlapping portion 41*b* in contact with the second magnetic layer 12. The overlapping portion 41*a* corresponds to the overlapping region, and the non-overlapping portion 41*b* corresponds to the non-overlapping region. The overlapping portion 41*a* and the non-overlapping portion 41*b* are both indicated by hatching.

Since the overlapping portion 41*a* and the non-overlapping portion 41*b* have different reflection spectra, when viewed from the outer surface of the first external terminal 41 (e.g., when viewed in the first direction Z), the overlapping portion 41*a* and the non-overlapping portion 41*b* are different in at least one of brightness, saturation, and hue. As a result, the overlapping portion 41*a* and the non-overlapping portion 41*b* can be identified visually or by a device. The portions may be identified when any light of a predetermined wavelength among infrared light, visible light, ultraviolet light, etc. is applied, for example. If the predetermined light exists in the wavelength region of visible light, the overlapping portion 41*a* and the non-overlapping portion 41*b* can more easily be identified.

An outer surface of the overlapping portion 41*a* and an outer surface of the non-overlapping portion 41*b* are different in degree of unevenness. The degree of unevenness on the outer surface of the non-overlapping portion 41*b* is larger than the degree of unevenness on the outer surface of the overlapping portion 41*a*. For example, a surface roughness Ra of the non-overlapping portion 41*b* is larger than a surface roughness Ra of the overlapping portion 41*a*. For example, the surface roughness Ra of the non-overlapping portion 41*b* is not less than 1.5 times and not more than 2.5 times (i.e., from 1.5 times to 2.5 times) the surface roughness Ra of the overlapping portion 41*a*.

The surface roughness Ra of the overlapping portion 41*a* is different from the surface roughness Ra of the non-overlapping portion 41*b* as described above since the overlapping portion 41*a* is formed on an upper surface of the first columnar wiring 31 while the non-overlapping portion 41*b* is formed on an upper surface of the magnetic layers 11, 12. Specifically, since the first columnar wiring 31 is made of metal, the upper surface of the first columnar wiring 31 becomes smooth. On the other hand, since the magnetic layers 11, 12 are made of a composite material containing a resin and a metal magnetic powder, the upper surface of the magnetic layers 11, 12 becomes rough. Since the overlapping portion 41*a* is formed on the upper surface of the first columnar wiring 31, the shape of the upper surface of the first columnar wiring 31 is transferred to the overlapping portion 41*a*. On the other hand, since the non-overlapping portion 41*b* is formed on the upper surface of the magnetic layers 11, 12, the shape of the upper surface of the magnetic layers 11, 12 is transferred to the non-overlapping portion 41*b*. Therefore, the surface of the non-overlapping portion 41*b* is rougher than the surface of the overlapping portion 41*a*.

Since the outer surface of the overlapping portion 41*a* and the outer surface of the non-overlapping portion 41*b* are different in degree of unevenness, the overlapping portion 41*a* and the non-overlapping portion 41*b* can be identified by using the brightness of the reflection spectrum. Specifically, since the degree of unevenness of the outer surface of the non-overlapping portion 41*b* is larger than the degree of unevenness of the outer surface of the overlapping portion 41*a*, the portions having the reflection spectra with lower brightness and higher brightness can be identified as the overlapping portion 41*a* and the non-overlapping portion 41*b*, respectively.

Therefore, since the overlapping region (the overlapping portion 41*a*) of the first external terminal 41 and the non-overlapping region (the non-overlapping portion 41*b*) of the first external terminal 41 have different reflection spectra when light of a predetermined wavelength is applied from the outer surface side, the overlapping region (the overlapping portion 41*a*) and the non-overlapping region (the non-overlapping portion 41*b*) can be identified. As a result, even after the first external terminal 41 is formed, a connection position between the first external terminal 41 and the inductor wiring 20 (the first vertical wiring 51) can be perceived. Thus, a component with deteriorated connectivity between the first external terminal 41 and the inductor wiring 20 can be selected.

The same applies to the positional relationship between the second external terminal 42 and the second vertical wiring 52. Specifically, the second external terminal 42 has an overlapping region on the inductor wiring 20 (the second vertical wiring 52) and a non-overlapping region not in contact with the inductor wiring 20 (the second vertical wiring 52), and the overlapping region and the non-overlapping region have different reflection spectra when light of a predetermined wavelength is applied from the outer surface side. The second external terminal 42 has an overlapping portion on the inductor wiring 20 corresponding to the overlapping region and a non-overlapping portion on the second magnetic layer 12 corresponding to the non-overlapping region.

As shown in FIG. 2, the laminated body 10 has an overlapping portion 50*a* that is the insulating coating film 50 on the inductor wiring 20 (the first vertical wiring 51) corresponding to the overlapping region and a non-overlapping portion 50*b* that is the insulating coating film 50 on the second magnetic layer 12 (see FIG. 1B) corresponding to the non-overlapping region. The overlapping portion 50*a* and the non-overlapping portion 50*b* are both indicated by hatching. The overlapping portion 50*a* and the non-overlapping portion 50*b* have different reflection spectra when light of a predetermined wavelength is applied from the outer surface side. Therefore, the overlapping portion 50*a* and the non-overlapping portion 50*b* in the laminated body 10 (the insulating coating film 50) can be identified. As a result, even after the first external terminal 41 is formed, a connection position between the first external terminal 41 and the inductor wiring 20 (the first vertical wiring 51) can be perceived.

Preferably, the inductor wiring 20 (the first vertical wiring 51) is confirmable through the insulating coating film 50. As a result, the connection position between the first external terminal 41 and the inductor wiring 20 can more easily be perceived.

The same applies to the positional relationship between the second external terminal 42 and the second vertical wiring 52. Specifically, the laminated body 10 includes the overlapping portion 50*a* that is the insulating coating film 50 on the inductor wiring 20 (the second vertical wiring 52) corresponding to the overlapping region and the non-overlapping portion 50*b* that is the insulating coating film 50 on the second magnetic layer 12 corresponding to the non-overlapping region. The overlapping portion 50*a* and the non-overlapping portion 50*b* have different reflection spectra when light of a predetermined wavelength is applied from the outer surface side.

Figure 3:
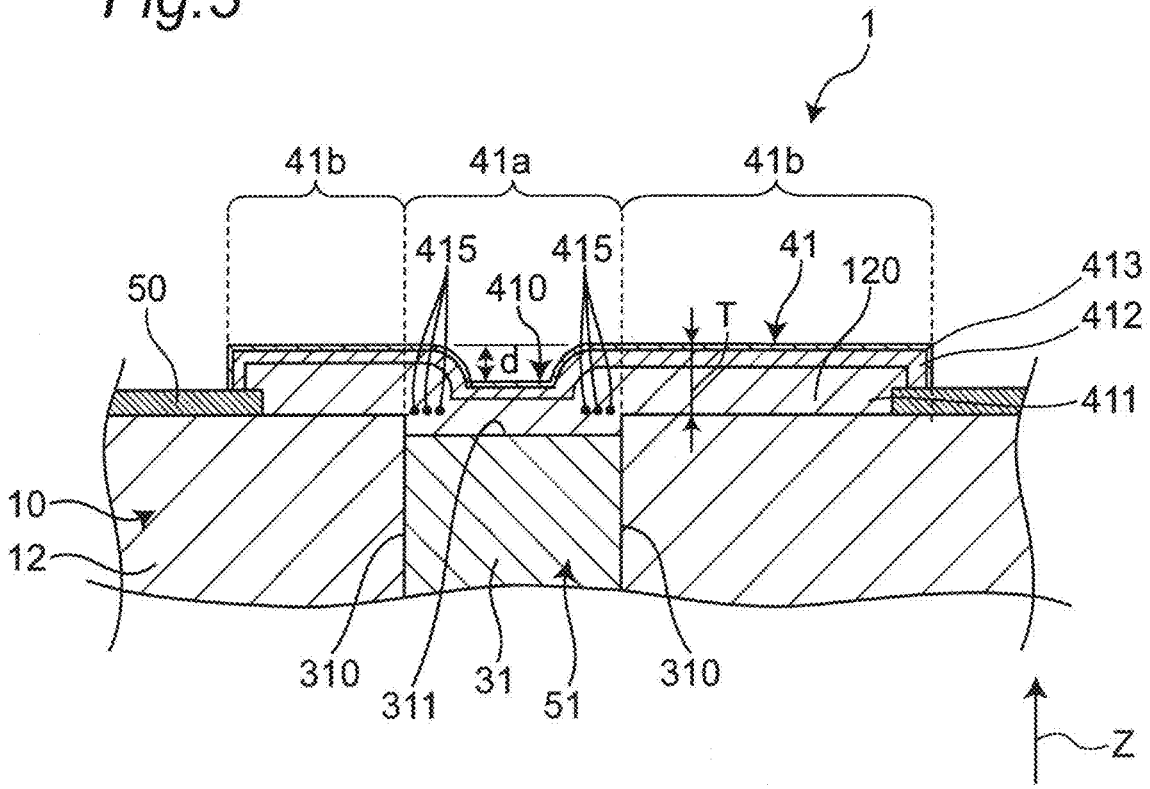
FIG. 3 is a cross-sectional view taken along a line A-A of FIG. 2.

FIG. 3 is a cross-sectional view taken along a line A-A of FIG. 2. FIG. 3 shows the first external terminal 41, and since the second external terminal 42 has the same configuration as the first external terminal 41, the first external terminal 41 will hereinafter be described, and the second external terminal 42 will not be described.

As shown in FIG. 3, the first external terminal 41 has a metal part and a resin part 415 (indicated by a black circle in FIG. 3). In the cross section of the first external terminal 41, the resin part 415 is enclosed in the metal part. Specifically, the metal part is made up of a first conductor layer 411 made of electroless-plated Cu, a second conductor layer 412 made of electroless-plated Ni, and a third conductor layer 413 made of electroless-plated Au. The resin part 415 is enclosed in the first conductor layer 411. A known catalyst layer of Pd etc. may be disposed between the conductor layers, and the conductor layers without the catalyst layer interposed therebetween may be mixed with the conductor layers with the catalyst layer interposed therebetween.

The resin part 415 is enclosed in the metal part, and the metal part is not enclosed in the resin part. This means that the first external terminal 41 is not made of a conductive resin paste. The term "enclosed" means that the resin part 415 is embedded in the metal part without being exposed.

As a result, since the first external terminal 41 has the resin part 415 enclosed in the metal part, the stress and the external force applied to the first external terminal 41 can be reduced by the resin part 415. Therefore, the reliability of the first external terminal 41 can be improved. The coefficient of expansion of the first external terminal 41 due to heat can be made closer to the magnetic layers 11, 12 containing a resin, and even when a load such as heat is applied to the inductor component 1, accumulation of stress due to a difference in thermal expansion coefficient between the laminated body 10 and the first external terminal can be reduced, so that the reliability of the first external terminal 41 can be improved. Particularly, in the case of the inductor component 1 of a thin type, the warpage of the inductor component 1 can be suppressed when the thermal expansion coefficient of the first external terminal 41 is close to the magnetic layers 11, 12.

The resin part 415 is formed under intentional control. An example of a method of forming the resin part 415 will be described. After the insulating coating film 50 is disposed on the upper surface of the second magnetic layer 12, when the insulating coating film 50 is patterned to form an opening, a residue of the patterned insulating coating film 50 is allowed to enter the opening as the resin part 415. Subsequently, by forming the first external terminal 41 in the opening of the insulating coating film 50 by electroless plating, the resin part 415 flows into a plating solution, and the resin part 415 enclosed in the metal part of the first external terminal 41 can be formed.

The method of forming the resin part 415 is not limited to the method described above. For example, a resin residue in the second magnetic layer 12 at the time of grinding the second magnetic layer 12 may be used as the resin part 415 instead of the residue of the patterning of the insulating coating film 50. Alternatively, instead of using the resin residue of the insulating coating film 50 or the second magnetic layer 12 as the resin part 415, another resin may freshly be poured in at the time of formation of the first external terminal 41. For example, after the second magnetic layer 12 is roughly ground, a resin may thinly be applied to the entire upper surface of the second magnetic layer 12, and the resin may be peeled off (developed) so as to use the resin that enters mark portions remaining on the second magnetic layer 12, the first vertical wiring 51 (the first columnar wiring 31), etc. due to the rough grinding and that remains after the peeling-off (development). Alternatively, instead of a residue of patterning or grinding, for example, a material serving as the resin part 415 may separately be mixed in a plating solution for forming the first external terminal 41 so as to form the metal part enclosing the resin part 415.

Preferably, the first external terminal 41 has a void part enclosed in the metal part. Therefore, the stress and the external force applied to the first external terminal 41 can be reduced. Preferably, the resin part 415 is in contact with the void part. Therefore, the void part can absorb a change in volume of the resin part 415 easily expanded and contracted due to a thermal load etc., so as to reduce a change in volume of the first external terminal 41 as a whole, thereby reducing the stress accumulated in the first external terminal 41.

For a method of forming the void part of the first external terminal 41, for example, a portion of the resin part 415 may physically or scientifically be removed by heat or chemicals at the time of formation of the resin part 415. Specifically, an alkaline plating solution is used for forming the metal part enclosing the resin part 415. As a result, plating is achieved for a metal part around the resin part 415, and a portion of the resin part 415 is dissolved or lifted off by the alkaline plating solution during formation of the metal part enclosing the resin part 415, so that the void part enclosed in the metal part can be formed at the same time.

Alternatively, a hydrophobic treatment may be applied at the time of formation of the metal part to reduce the wettability of the metal part and reduce detachment of a bubble attached to the metal part during formation, so as to use the bubble enclosed in the metal part as the void part. Alternatively, when the catalyst layer or the second conductor layer 412 is formed on the first conductor layer 411, the first conductor layer 411 serving as an underlayer may strongly be corroded so as to form the void part enclosed in the metal part of the first conductor layer 411.

Preferably, the thickness of inductor component 1 is 0.3 mm or less. The thickness of the inductor component 1 refers to the dimension of the inductor component 1 along the first direction Z. Therefore, since the inductor component 1 is formed as a thin type component so that the thickness of the first external terminal 41 tends to be relatively large, the reduction of the stress and the external force by the resin part 415 becomes more effective. Additionally, the inductor component 1 can be mounted on a larger number of positions on an internal substrate of a semiconductor component or an electronic module, for example, and therefore, a mounting density on a substrate can be increased.

Preferably, the thickness of the resin part 415 is not less than 1/200 and not more than 1/5 (i.e., from 1/200 to 1/5) of the thickness of first external terminal 41. When the first external terminal 41 is made up of multiple metal layers, the thickness of the first external terminal 41 is a thickness including all the metal layers. Therefore, since the thickness of the resin part 415 is not more than 1/5 of the thickness of the first external terminal 41, an increase in DC resistance and a decrease in terminal strength can be suppressed in the first external terminal 41. Since the thickness of the resin part 415 is not less than 1/200 of the thickness of the first external terminal 41, the effect of the resin part 415 reducing the stress can reliably be produced.

Preferably, the thickness of the first external terminal 41 is not more than 1/20 of the thickness of inductor component 1. Therefore, since the first external terminal 41 is formed thinly so that the reliability of the first external terminal 41 tends to be a problem, the reduction of the stress and the external force by the resin part 415 becomes more effective. Additionally, an influence on the region of the inductor wiring 20 can be reduced in the limited volume of the inductor component 1, so that the electrical characteristics of the inductor component 1 can appropriately be ensured.

Preferably, the thickness of each of the conductor layers of the first external terminal 41 is 10 μm or less. Therefore, each of the conductor layers of the first external terminal 41 is thin and has a structure in which reliability tends to be a problem, so that the reduction of the stress and the external force by the resin part 415 becomes more effective. Additionally, an influence on the region of the inductor wiring 20 can be reduced in the limited volume of the inductor component 1, so that the electrical characteristics of the inductor component 1 can appropriately be ensured.

Preferably, the resin part 415 contains at least one of epoxy, acrylic, phenol, and polyimide resins. Therefore, a commonly-used resin can be used for the resin part 415, so that the productivity is improved. Preferably, the material of the resin part 415 is the same as the material of the resin of the magnetic layers 11, 12 or the material of the insulating coating film 50. As a result, the effect of bringing the stress of the first external terminal 41 closer to the laminated body 10 is further enhanced.

Preferably, the resin part 415 contains silicon. Therefore, the diffusibility of the resin part 415 is improved in the first external terminal 41. As a result, the resin part 415 can be disposed in the entire external terminal, and the effect of the resin part 415 reducing the stress and the external force applied to the first external terminal 41 can more easily be obtained. If the magnetic layers 11, 12 contain a silica filler so as to ensure insulation, the linear expansion coefficients of the resin part 415 and the magnetic layers 11, 12 can be matched, which increases the effect of stress reduction.

Preferably, based on a surface 120 of the second magnetic layer 12, the resin part 415 is within a range of −5 μm to 5 μm in a direction (the first direction Z) perpendicular to the surface 120. The positive direction is the forward direction of the first direction Z. Therefore, the resin part 415 is located near the surface 120 of the second magnetic layer 12, so that when the second magnetic layer 12 is warped due to a stress etc., the stress can be reduced on the surface 120 of the second magnetic layer 12 having a largest amount of change, and the reliability of the first external terminal 41 can be improved.

Preferably, the resin part 415 is within a range of 5 μm from a circumferential edge 310 of the first columnar wiring 31 toward the inside of the first columnar wiring 31 in planar view. Therefore, the resin part 415 is located near the second magnetic layer 12, so that when the magnetic layers 11, 12 are warped due to a thermal load, the stress of the first external terminal 41 can be reduced on the surface 120 of the second magnetic layer 12 to which the largest stress is applied.

Preferably, the outer surface of the overlapping portion 41*a* of the first external terminal 41 has a concave part 410 at a position lower than the outer surface of the non-overlapping portion 41*b* of the first external terminal 41. A bottom surface of the concave part 410 is at a position lower than the outer surface (upper surface) of the non-overlapping portion 41*b*.

An example of a method of forming the concave part 410 will be described. By performing soft etching after the first columnar wiring 31 is formed in the magnetic layers 11, 12, the first columnar wiring 31 is etched, so that the upper surface of the first columnar wiring 31 becomes lower than the upper surface of the magnetic layers 11, 12. Subsequently, the first external terminal 41 is formed by electroless plating on the first columnar wiring 31 and the magnetic layers 11, 12, so that the portion of the first external terminal 41 on the first columnar wiring 31 is formed at a position lower than the portion of the first external terminal 41 on the magnetic layers 11, 12. In this way, the concave part 410 is formed in the overlapping portion 41*a* of the first external terminal 41 on the first columnar wiring 31.

Therefore, since the first external terminal 41 has the concave part 410, stable mounting can be achieved due to a self-alignment effect causing a solder ball or a solder paste used at the time of mounting to flow into the concave part 410.

Preferably, the first external terminal 41 has a crack. As a result, the stress accumulated in the first external terminal 41 is released by the crack.

Preferably, when a thickness T of the first external terminal 41 is 1, a depth d of the concave part 410 is 0.05 or more and less than 1 (i.e., from 0.05 to less than 1). This enables suppression of application of excessive stress due to a level difference of the concave part 410, while reliably ensuring the self-alignment effect of the concave part 410.

The thickness T of the first external terminal 41 is the thickness of the portion (the non-overlapping portion 41*b*) of the first external terminal 41 in contact with the magnetic layers 11, 12 and is, for example, the thickness of a central part in a cross-sectional width direction of the non-overlapping portion 41*b* of the first external terminal 41. When the first external terminal 41 is made up of the first conductor layer 411, the second conductor layer 412, and the third conductor layer 413, and the first columnar wiring 31 is made of electrolytic-plating Cu, an interface between the first conductor layer 411 made of electroless-plated Cu and the first columnar wiring 31 is hardly identified. This makes it difficult to measure the thickness in the portion (the overlapping portion 41*a*) of the first external terminal 41 in contact with the first columnar wiring 31. Therefore, the thickness of the first external terminal 41 can easily be measured by measuring the thickness in the portion (the non-overlapping portion 41*b*) of the first external terminal 41 in contact with the magnetic layers 11, 12.

The present disclosure is not limited to the embodiments described above and may be changed in design without departing from the spirit of the present disclosure. For example, in the embodiment, the inductor wiring 20 has a spiral shape; however, as described above, the shape of the inductor wiring 20 is not limited, and various known shapes are usable.

In the embodiment, the first external terminal and the second external terminal have the features of the embodiment; however, at least the first external terminal may have the features between the first external terminal and the second external terminal.

In the embodiment, the vertical wiring is made up of the via conductor and the columnar wiring; however, the insulating layer may not be formed so that the vertical wiring includes only the columnar wiring. In the embodiment, the wiring extends in the first direction as the lead-out wiring; however, the wiring may extend in a direction orthogonal to the first direction and may be led out to a side surface of the magnetic layer.

FIRST EXAMPLE

Figure 4:
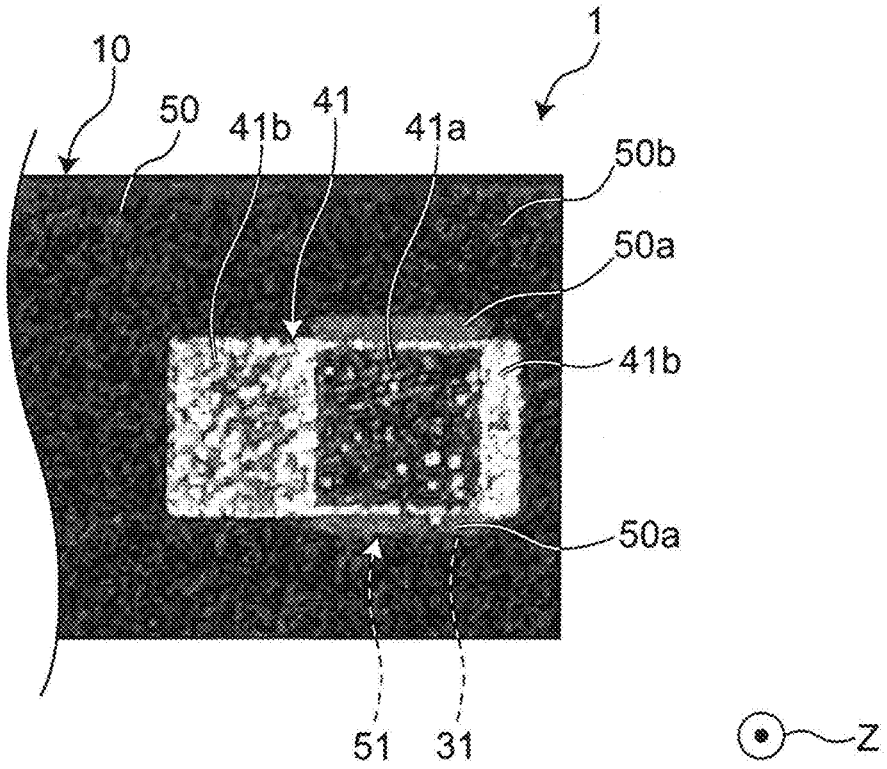
FIG. 4 is a view of an image showing an example of the first embodiment.

FIG. 4 is a view of an image of a scanning electron microscope showing an example of the embodiment (FIG. 2). As shown in FIG. 4, in the first external terminal 41, the overlapping portion 41*a* and the non-overlapping portion 41*b* have different reflection spectra. Specifically, the degree of unevenness of the non-overlapping portion 41*b* is larger than the degree of unevenness of the overlapping portion 41*a*. Therefore, the overlapping portion 41*a* and the non-overlapping portion 41*b* are different in brightness and hue, and the overlapping portion 41*a* becomes darker than the non-overlapping portion 41*b*, so that the overlapping portion 41*a* and the non-overlapping portion 41*b* can visually be identified. The portions visually identifiable in this way can easily be classified.

In the laminated body 10 (the insulating coating film 50), the overlapping portion 50*a* and the non-overlapping portion 50*b* have different reflection spectra. Specifically, the overlapping portion 50*a* and the non-overlapping portion 50*b* are different brightness and hue. Therefore, the overlapping portion 50*a* and the non-overlapping portion 50*b* can visually be identified. The portions visually identifiable in this way can easily be classified. The first columnar wiring 31 is confirmable through the insulating coating film 50. Therefore, the first columnar wiring 31 can be recognized directly under the first external terminal 41 and directly under the insulating coating film 50.

Figure 5:
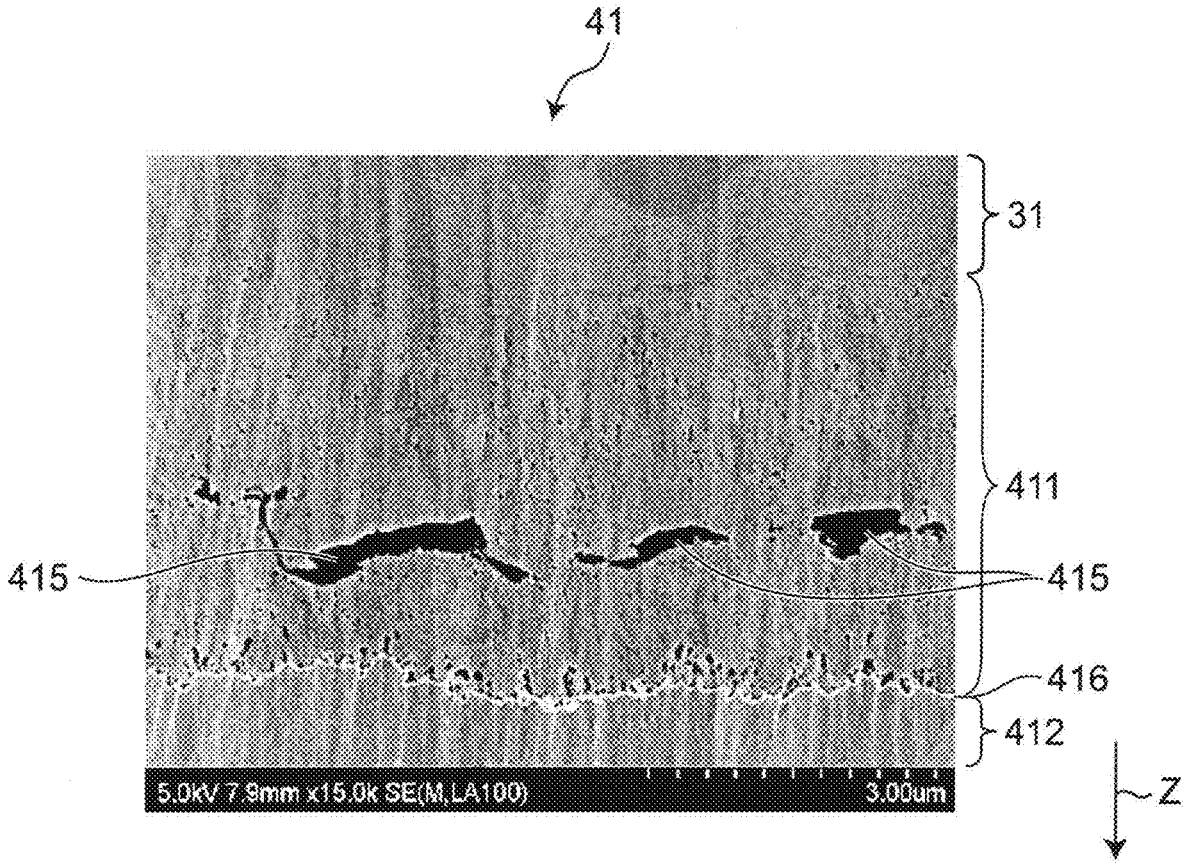
FIG. 5 is a view of an image showing an example of the first embodiment.

FIG. 5 is a view of an image of a scanning electron microscope showing an example of the embodiment (FIG. 3). FIG. 5 is a view of an image acquired by cutting the inductor component at a central portion. In FIG. 5, the downward direction is the Z direction. As shown in FIG. 5, the first external terminal 41 has the first conductor layer 411 on the first columnar wiring 31, a catalyst layer 416 on the first conductor layer 411, and the second conductor layer 412 on the catalyst layer 416. The first conductor layer 411 is made up of an electroless-plated Cu film. The catalyst layer 416 is made of a Pd layer. The second conductor layer 412 is made up of an electroless-plated Ni film. The resin part 415 is enclosed in the first conductor layer 411 (the metal part).

What is claimed is:

1. An inductor component comprising:

a laminated body having a magnetic layer containing a resin and a metal magnetic powder contained in the resin;

an inductor wiring disposed in the laminated body; and an external terminal exposed from the laminated body, the external terminal including a metal part and a resin part, and in a cross section of the external terminal, the resin part is enclosed in the metal part such that the resin part is entirely surrounded by the metal part.

2. The inductor component according to claim 1, wherein the external terminal has a void part enclosed in the metal part.

3. The inductor component according to claim 2, wherein the resin part is in contact with the void part.

4. The inductor component according to claim 1, wherein a thickness of the inductor component is 0.3 mm or less.

5. The inductor component according to claim 1, wherein a thickness of the resin part is from 1/200 to 1/5 of the thickness of the external terminal.

6. The inductor component according to claim 1, wherein a thickness of the external terminal is not more than 1/20 of the thickness of the inductor component.

7. The inductor component according to claim 1, wherein the external terminal includes a plurality of conductor layers, and at least one of the conductor layers is formed by plating.

8. The inductor component according to claim 7, wherein a thickness of each of the conductor layers of the external terminal is 10 μm or less.

9. The inductor component according to claim 1, wherein the resin part contains at least one of epoxy, acrylic, phenol, and polyimide resins.

10. The inductor component according to claim 1, wherein the resin part contains silicon.

11. The inductor component according to claim 1, wherein based on a surface of the magnetic layer, the resin part is within a range of −5 μm to 5 μm in a direction perpendicular to the surface.

12. The inductor component according to claim 1, wherein the inductor wiring has a columnar wiring penetrating the magnetic layer, the external terminal is located on the columnar wiring, and the resin part is within a range of 5 μm from a circumferential edge of the columnar wiring toward the inside of the columnar wiring in planar view.

13. The inductor component according to claim 1, wherein the external terminal includes an overlapping portion on the inductor wiring and a non-overlapping portion on the magnetic layer, and the overlapping portion and the non-overlapping portion have different reflection spectra when light of a predetermined wavelength is applied from the outer surface side.

14. The inductor component according to claim 13, wherein a degree of unevenness on an outer surface of the non-overlapping portion is larger than a degree of unevenness on an outer surface of the overlapping portion.

15. The inductor component according to claim 1, wherein the laminated body further includes an insulating coating film disposed on the surface of the magnetic layer, and the insulating coating film is disposed around the external terminal.

16. The inductor component according to claim 15, wherein a side surface of the external terminal is in contact only with the insulating coating film.

17. The inductor component according to claim 15, wherein the inductor wiring is confirmable through the insulating coating film.

18. An inductor component comprising:

a laminated body having a magnetic layer containing a resin and a metal magnetic powder contained in the resin;

an inductor wiring disposed in the laminated body, the inductor wiring having a columnar wiring penetrating the magnetic layer; and an external terminal located on the columnar wiring and exposed from the laminated body, the external terminal including a metal part and a resin part, the resin part being within a range of 5 μm from a circumferential edge of the columnar wiring toward the inside of the columnar wiring in planar view, and in a cross section of the external terminal, the resin part is enclosed in the metal part.

19. An inductor component comprising:

a laminated body having a magnetic layer containing a resin and a metal magnetic powder contained in the resin;

an inductor wiring disposed in the laminated body; and an external terminal exposed from the laminated body, the external terminal including a metal part and a resin part, and in a cross section of the external terminal, the resin part is enclosed in the metal part, and the external terminal including an overlapping portion on the inductor wiring and a non-overlapping portion on the magnetic layer, the overlapping portion and the non-overlapping portion having different reflection spectra when light of a predetermined wavelength is applied from the outer surface side.

20. The inductor component according to claim 19, wherein a degree of unevenness on an outer surface of the non-overlapping portion is larger than a degree of unevenness on an outer surface of the overlapping portion.

* * * * *